US008176680B2

(12) United States Patent
Chubb et al.

(10) Patent No.: US 8,176,680 B2
(45) Date of Patent: May 15, 2012

(54) SLIDING DOOR ASSEMBLY

(75) Inventors: Richard A. Chubb, Voorhees, NJ (US); Ralph R. Wearsch, Huntersville, NC (US)

(73) Assignee: Thermoseal Industries, L.L.C., Gloucester, NJ (US)

( * ) Notice: Subject to any disclaimer, the term of this patent is extended or adjusted under 35 U.S.C. 154(b) by 985 days.

(21) Appl. No.: 11/544,215

(22) Filed: Oct. 6, 2006

(65) Prior Publication Data

US 2008/0092452 A1 Apr. 24, 2008

(51) Int. Cl.
*E05D 13/00* (2006.01)

(52) U.S. Cl. ..... 49/425; 49/501; 49/504

(58) Field of Classification Search ..... 49/404, 49/425, 501, 504
See application file for complete search history.

(56) References Cited

U.S. PATENT DOCUMENTS

| | | | | | |
|---|---|---|---|---|---|
| 3,859,754 | A * | 1/1975 | Budich et al. | 49/425 |
| 3,978,617 | A * | 9/1976 | Eventoff | 49/404 |
| 4,227,346 | A * | 10/1980 | Kubik | 49/425 |
| 4,286,716 | A * | 9/1981 | Budich et al. | 206/577 |
| 4,398,373 | A * | 8/1983 | Mancuso | 49/425 |
| 4,428,156 | A * | 1/1984 | Malm et al. | 49/501 |
| 4,554,770 | A * | 11/1985 | Anders | 52/204.51 |
| 4,555,868 | A * | 12/1985 | Mancuso | 49/181 |
| 4,831,781 | A * | 5/1989 | Morton | 49/504 |
| 4,856,230 | A * | 8/1989 | Slocomb | 49/504 |
| 4,941,288 | A * | 7/1990 | Morton | 49/504 |
| 4,944,118 | A | 7/1990 | Biro | |
| 5,042,199 | A * | 8/1991 | Schneider et al. | 49/446 |
| 5,099,624 | A * | 3/1992 | Valentin | 52/207 |
| 5,203,116 | A * | 4/1993 | Chen | 49/404 |
| 5,274,955 | A * | 1/1994 | Dallaire et al. | 49/406 |
| 5,280,686 | A * | 1/1994 | Davies | 49/209 |
| 5,515,652 | A * | 5/1996 | Klimek | 49/501 |
| 5,884,361 | A * | 3/1999 | Richardson et al. | 16/100 |
| 6,675,537 | B2 * | 1/2004 | Morton et al. | 49/504 |
| 6,826,871 | B2 * | 12/2004 | Morton et al. | 49/504 |
| 6,952,899 | B2 * | 10/2005 | Herrmann et al. | 49/504 |
| 7,246,466 | B2 * | 7/2007 | Turner | 49/504 |
| 7,430,832 | B2 * | 10/2008 | Hung | 49/404 |
| 2007/0022667 | A1 * | 2/2007 | Olofsson | 49/504 |

* cited by examiner

*Primary Examiner* — Jerry Redman
(74) *Attorney, Agent, or Firm* — Francis C. Hand; Carella, Byrne, et al.

(57) ABSTRACT

The frame and the sash of the sliding door assembly are each made of plastic. The frame extrusion profile utilizes an opposing open-leg or C-channel construction that creates an interior accessory slot that is utilized throughout the overall construction to create a carrier that can accept a wide variety of snap-in accessory extrusions or components. Similarly, the sash extrusion profile allows for the use of snap-in accessories.

28 Claims, 14 Drawing Sheets

SLIDING DOOR ASSEMBLY

This invention relates to a sliding door assembly. More particularly, this invention relates to a sliding glass door assembly for refrigeration cabinets and for refrigerated storage rooms or spaces.

As is known, various types of refrigerated cabinets have been used for storing and displaying food products, such as bottled drinks and the like. In some cases, such as described in U.S. Pat. No. 7,043,886, the cabinets have employed a swing door that is constructed with a non-metallic frame in order to overcome the problems associated with swing doors made of metal. In other cases, the cabinets have been provided with a sliding glass door assembly.

For more than 20 years, the industry standard has been for sliding glass door systems to be assembled piece-by-piece (or "built-up"). In some cases, these doors have been fabricated and sold as units that can be incorporated into cabinets by others. In other cases, the doors have been fabricated on an OEM assembly line or door production operation. These systems were not designed as a fully integrated door system, nor were they capable of being installed as a fully assembled unit. Traditionally, sliding glass door frame components are supplied to an OEM assembly operation and installed by the customer or OEM as pre-mitered or pre-fabricated, cut-to-length "pieces", which are then mechanically-fastened to an opening in a refrigerator cabinet or refrigerated storage space one piece at a time, with the expectation that the typically mitered joints would line up without any "gaps" that might be objectionable to either the end user or to regulatory agencies, such as NSF or UL that oversee safety, sanitation and overall construction guidelines for commercial refrigeration and foodservice applications. The reality is that these mitered joints frequently failed to properly "line up" or "join", and were therefore "caulked" or "sealed" in such a way as to close any gaps, or were tediously "shimmed" during installation to align the miter joints, often resulting in caulking of the inner side of the installed frames to make up for any gaps between the frame and opening that occurred due to shimming behind the frame material.

Traditionally, sliding glass door components (e.g., PVC, fiberglass-reinforced plastic, aluminum extrusions, and the like) are mechanically fastened "around" an insulating glass pack or unit or monolithic piece of glass. These designs typically employ U-shaped extrusions that fit tightly around the glass lite or unit or they are mechanically fastened as empty "door frames" prior to "dropping in" the glass pack, unit or lite. These "drop-in" glass pack or panel designs typically employ L-shaped extrusions wherein the glass pack or lite of glass or inset panel is set into a pre-assembled frame and then sealed or "glazed" into place, and may have supplemental glazing beads or other glass retention components attached to the frame around the glass to further secure the glass pack, glass unit or monolithic lite of glass.

As is known, the use of a metallic frame for a sliding glass door or door frame system presents a problem in maintaining a refrigerated condition within a refrigerated cabinet due to the fact that metals are good conductors of heat. In other words, they have a high coefficient of heat transfer, and are thus "thermally conductive." Thus, metallic frames have been provided with insulating "thermal breaks" to reduce heat transfer across the extrusion, or with electrically-powered resistive heater wire to "warm up" the metallic extrusions to prevent condensation from forming on the metallic surfaces.

As is also known, double or triple paned glass doors that have been used for refrigerated cabinets can have condensation formed on the exterior of the glass due to a heat differential between cold air inside a cabinet and warm air outside the cabinet. In order to prevent this condensation, the doors have typically been provided with an electrical heating means to elevate the temperature on the exterior surface of the glass so that it is above the dew point of the ambient air on the exterior of the refrigerated cabinet, which thus reduces or precludes the formation of condensation that can materially obstruct the view through the glass door. However, where the door frames are made of metal, special precautions need to be taken to insulate the electrical current conductors associated with heating the framing material from the metal of the frames as, otherwise, a user may be subject to an electrical shock.

Accordingly, it is an object of this invention to provide a fully assembled sliding door assembly that can be readily installed by an end user.

It is another object of the invention to provide a sliding door assembly that utilizes components that can be readily replaced in the field.

It is another object of the invention to provide a sliding glass door assembly that can be easily mounted or installed on a commercial refrigeration cabinet or refrigerated storage space.

It is another object of the invention to provide a door assembly that incorporates a welded plastic frame and welded plastic sash as a fully integrated assembly.

It is another object of the invention to reduce the cost of fabricating sliding glass door assemblies for refrigeration cabinets.

It is another object of the invention to provide a door assembly employing a frame and a sash made substantially completely of plastic.

It is another object of the invention to dramatically reduce the thermal conductivity of an entire door assembly and to reduce or eliminate a need for supplemental means for reducing or eliminating condensation.

It is another object of the invention to provide a fully integrated door assembly that can be installed without fasteners into a commercial refrigeration cabinet or refrigerated storage space if so desired by an OEM manufacturer of commercial refrigeration cabinets or storage spaces/environments.

Briefly, the invention is directed to a sliding door assembly that is comprised of a frame and at least one "door" or "sash" that is slidably disposed in the frame to move laterally between a closed position and an open position relative to the frame.

In accordance with the invention, the frame is made of a plurality of plastic extrusion profiles that are integrally secured together to define a rectangular opening with each profile having a mitered end integrally secured to the mitered end of an adjacent profile. The sliding glass door or sash is also made of a plurality of plastic extrusion profiles that are integrally secured together to define an rectangular opening with each profile having a mitered end integrally secured to the mitered end of an adjacent profile.

In one embodiment, the sliding door assembly is constructed with a pair of doors or sashes that can be moved in overlapping relation to each other within the frame.

In another embodiment, the sliding door assembly is provided with a trio of sashes wherein each of the sashes is moveable laterally of the frame.

In additional embodiments, the sliding door assembly may be provided with multiple doors oriented similarly to the trio of doors, limited only by the physical constraints of the maximum width of a cabinet that might be manufactured by an OEM commercial refrigerator manufacturer, or by dimensional restrictions that may be imposed by the thermal welding equipment for joining the plastic extrusions that make up the frame and door system.

The plastic extrusion profiles of the frame are identical in construction and each has a main section with a cross-section of generally C-shape and an optional peripheral section. The main section has a pair of parallel end walls with a parallel intermediate wall therebetween that separates the profile into a pair of longitudinal recesses. In addition, an upstanding channel is disposed in each one of the longitudinal recesses. The peripheral section is hollow and is shaped to fit about a wall of a refrigerated cabinet or the like to present an aesthetically pleasing rounded appearance. In an alternate embodiment of this frame, the rounded exterior surface of the frame extrusion can be removed during or after extruding to create an alternate frame cross section that "drops into" the face of the cabinet while creating a "flush mounted" assembly instead of a "surface mounted" assembly.

Since the frame profiles have the same cross-section, they may be formed from a single plastic extrusion that is cut at intervals into four individual profiles to form a rectangular opening with the respective ends of each profile being mitered.

The use of a thermal welding technique to integrally secure the mitered ends of the profiles together results in the mitered corners of the frame being very accurate and eliminates the need for sealants to "close the gap" that is common with mechanically-fastened frame constructions where mitered joints are typically open or unsealed. The technique also serves to close up any openings that may become bacteria-harboring in food and beverage applications. Further, the use of thermal welding creates a frame that is exceptionally strong and that does not loosen up over time and/or under heavy use. In addition, this manufacturing technique creates an integral, or "one-piece", frame that is dimensionally quite accurate and square prior to its installation into an OEM's refrigerated cabinet or storage unit, whereas traditional "piece-together" frame construction can only be as accurate or square as the opening that is created by the OEM door system customer during their manufacturing process, or that can be achieved by tedious shimming during installation of the frame members into a non-square opening.

After the frame profiles have been thermally welded together, various "snap-in" accessory components are installed in the profiles for various purposes.

For example, a pair of plastic track extrusions are snap-fitted into the upstanding channels of the lowermost horizontally disposed frame profile, i.e. the "sill" of the frame, for receiving the sashes. Each track extrusion is formed to define a rail that may also be provided with a stainless steel cover for rollably receiving a roller on the bottom of a sash.

In addition, a pair of elongated plastic covers are snap-fitted into the channels in each of the vertically disposed frame profiles to present a flat surface for "clean" appearance and to provide a place for a door or sash to close against using soft "bumpers" that can be installed into the vertical sides or "stiles" of a door to dampen closing forces. In an alternative embodiment, an elongated plastic extrusion with a removable elongated gasket can be snap-fitted into the channel of each vertically disposed frame profile against which a sash would impact on closing. This gasket functions to cushion the sash when the sash is moved into the closed position and also functions as a backup weather seal or air seal to reduce air infiltration into a cabinet on which the door assembly is mounted. The gasket is easily removed in the field to allow for replacement. Likewise, each of the plastic covers and the plastic extrusion may be easily removed and replaced in the field should such be necessary using the efficient "snap-in" installation that is provided. This installation method dramatically reduces the number of fasteners that are required to make a sliding door assembly. For example, a typical sliding door system built in the traditional historical manner may use 12-24 fasteners to make two sliding doors. In the construction described herein, there are no fasteners required to make a door. If fasteners that may be used by an OEM to permanently mount a frame to a refrigerated cabinet or storage facility opening are excluded, there are only two fasteners actually required in a complete two-door sliding door system in this construction and these are for securing a linear spring self-closing device (described below) to the frame.

Also, a pair of linear-spring-based self-closing door return assemblies are mounted on the uppermost horizontally disposed frame profile for biasing the two doors (or sashes) from their open positions to their closed positions. Each spring assembly includes an elongated coil spring and a molded plastic self-closing device that slides or glides back-and-forth inside the track that is created by virtue of the opposing C-channels built into the frame extrusion (i.e. a slider).

The spring is disposed in one of the respective channels in the uppermost frame profile with one end of the spring fixed in place within the channel via a threaded screw. The opposite end of the spring is secured to the molded plastic self-closing device (slider) that, in turn, is slidably mounted in the channel that is created by virtue of the opposing C-channels built into the frame extrusion.

The spring and self-closing device (slider) are positioned so that when a sash is moved from the closed position to an open position, the slider moves with the sash and the spring elongates. Thus, the spring serves to bias the slider against the sash and towards the closed position of the sash.

A plurality of access openings may be provided in the channels of the upper frame profile to permit access to the installation screws that fix the springs in place so that adjustments may be made in the tension of the springs, and so that springs or self-closing devices can be easily removed and/or replaced in the field should this be required at a later date due to wear, damage or any other similar requirement.

Further, an elongated seal is mounted on the intermediate wall of each frame profile for sealing against a side of a door or sash within the frame. In this respect, these seals are able to seal the entire perimeter of three sides of both sashes simultaneously without requiring full perimeter gasketing to be installed on both sides of each sash as otherwise has been standard practice in the field and in the vinyl window and door industry. This arrangement greatly simplifies the overall door/sash gasketing construction and greatly reduces the cost and problems associated with simultaneously sealing the "weather surfaces" of both sashes that are exposed to refrigerated air, and/or that are required to separate interior from exterior environment.

The plastic extrusion profiles of each sash have an identical cross-section except for one of the sash profiles being provided with an integral handle. Each sash profile has a pair of hollow parallel flanges that define an outwardly directed channel on one side, a single flange defining an inwardly directed ledge on an opposite side to receive an insulated glass unit or other non-glass installation, and a recess on this opposite side for receiving a glazing bead to secure an insulated glass unit in place.

As with the frame, three of the sash profiles may be fabricated from a single extrusion that is cut into three components, each of which is provided with mitered ends. The fourth sash profile is extruded with a projecting double walled hollow handle and is provided with mitered ends. The sash profiles are thermally welded to each other at the mitered ends.

Each door or sash is sized to be fitted into the frame in a simple manner, i.e. by holding the sash at an angle and inserting the two flanges at the upper end of the sash into the longitudinal recesses in the uppermost horizontal frame profile and then rotating the sash into a vertical plane and placing the lower end of the sash into the lowermost horizontal frame profile between the two end walls of the frame profile and onto a track extrusion rail with the two flanges at the lower end of the sash disposed in the longitudinal recesses in the sill. In this way, the upper and lower ends of the sash are positioned between the end walls of the upper and lower frame profiles.

In addition, each sash is provided with additional snap-in accessories that can be easily mounted in place during fabrication and removed for replacement in the field when required.

For example, each sash is provided with a pair of a wheel housing assemblies that are removably mounted in the lowermost one of the horizontally disposed profiles in a snap-in manner and carry wheels or rollers for rolling on the rails of the sill of the frame.

In addition, an elongated cover extrusion is mounted on the flanges of one of the vertically disposed sash profiles to present a flat aesthetic appearance at that edge of the sash. In addition, the cover extrusion has a longitudinal slot on one side of the profile that slidably receives an elongated seal such that the seal seals against the side of an adjacent sash when the two sashes are in a closed position in the frame.

A guide button may also be inserted in a flange of the sash to assist in aligning the top of the sash to ensure proper compression of the center seal between two or more adjacent sashes.

Also, instead of employing a gasket on the vertical frame profiles to cushion the impact of a sash, each sash may be provided with a pair of glued in place bumpers within the channel defined by the flanges at the side of the sash, one at the top of the sash and one at the bottom of the sash, to bump against the covered over channels of a vertical frame profile upon closing of the sash.

All of the components of the door assembly except for the screws that secure the springs of the spring assemblies and, possibly, the springs themselves, are made of plastic, such as a polyvinylchloride (PVC), or other non-metallic materials, such as neoprene. Further, whereas the frame profiles and sash profiles are intended to be the main structural components, the non-structural components can be easily replaced in the field should these components become damaged or worn out. These non-structural components include the plastic track extrusions, elongated plastic cover(s), elongated plastic extrusion(s), spring assemblies and seals of the frame and the roller assemblies, elongated cover extrusion and seal of the sash.

The door assembly can be readily installed into an opening in a commercial refrigeration cabinet or refrigerated space (such as a walk-in refrigerator or freezer storage room) as a fully-assembled unit, for example by an end-user on a manufacturing assembly line or on a job site for a refrigerated unit. Further, the door assembly does not normally require the addition of electrically powered supplemental heat or special insulation to the frame nor any insulation against associated electrical current or power supplies.

These and other objects and advantages of the invention will become more apparent from the following detailed description taken in conjunction with the accompanying drawings wherein.

Figure 17:
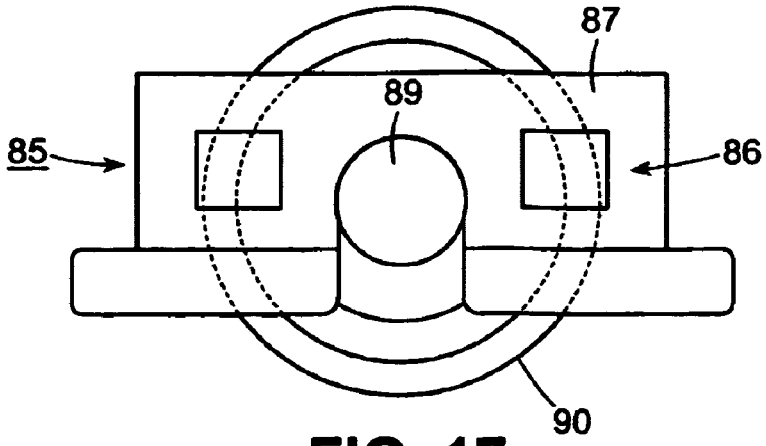
Figure 18:
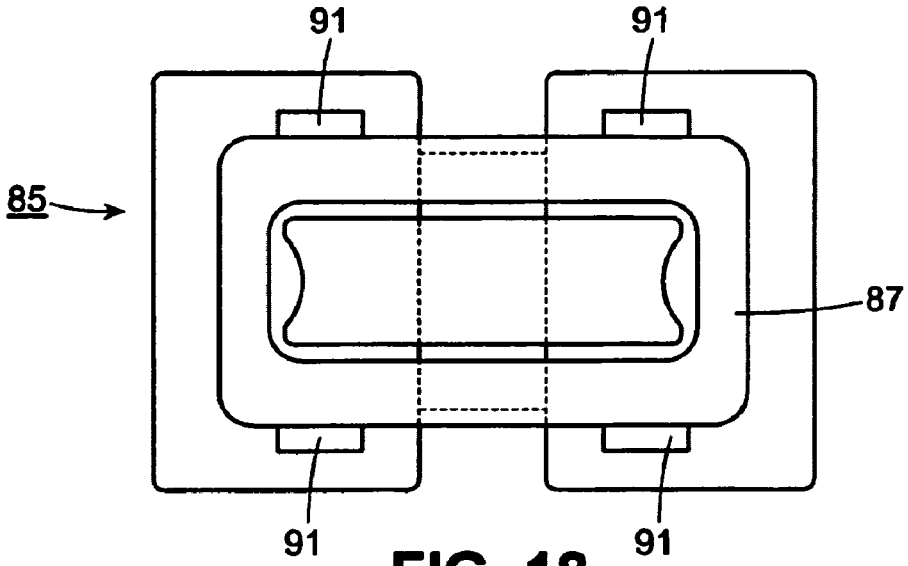
Figure 19:
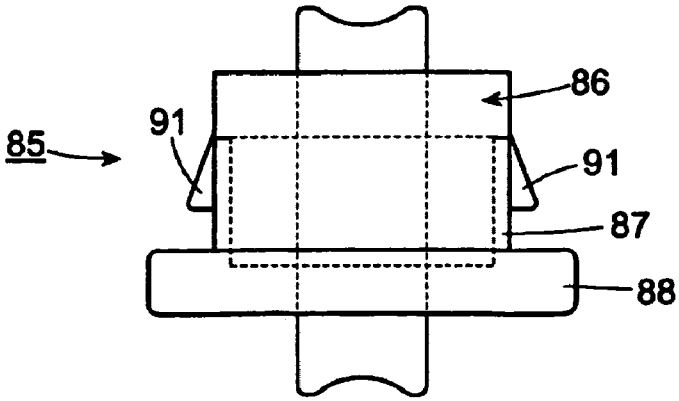
Figure 20:
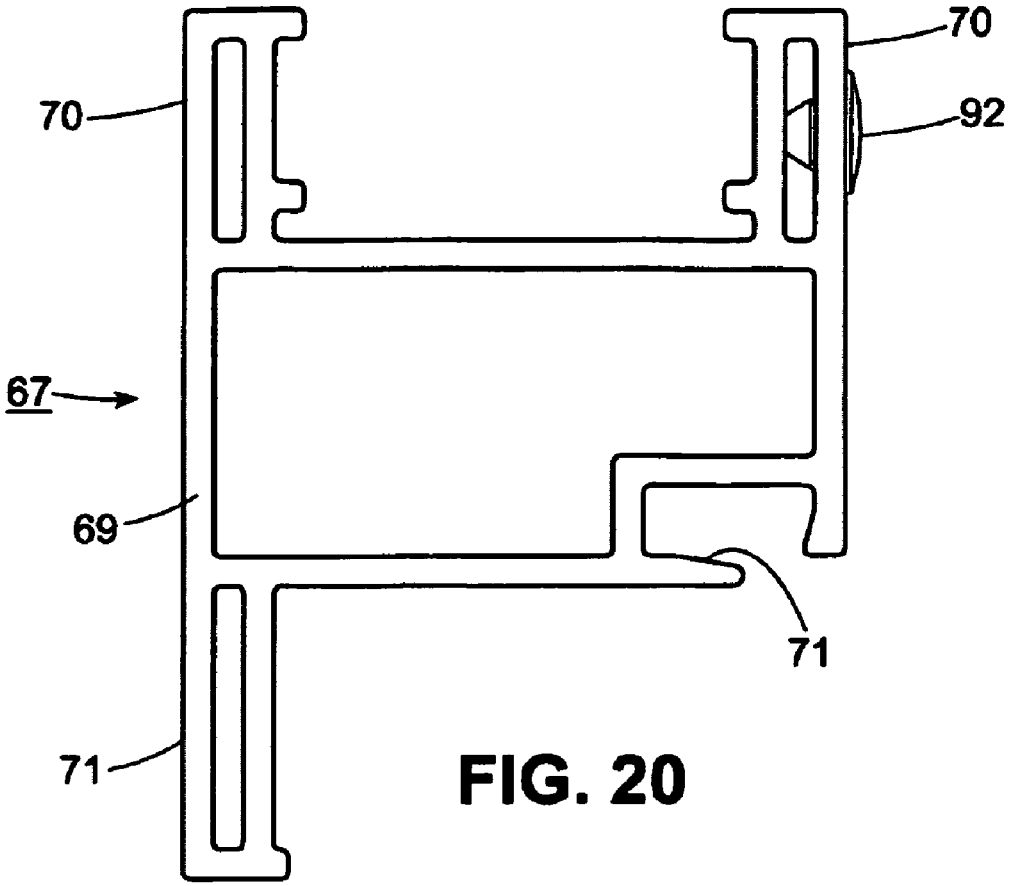
Figure 21:
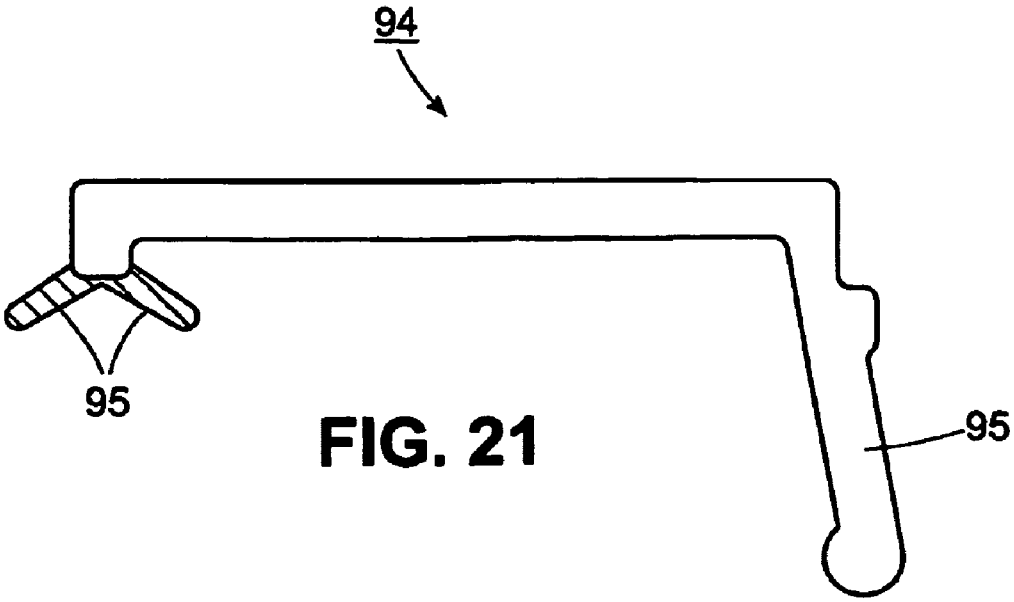
Figure 22:
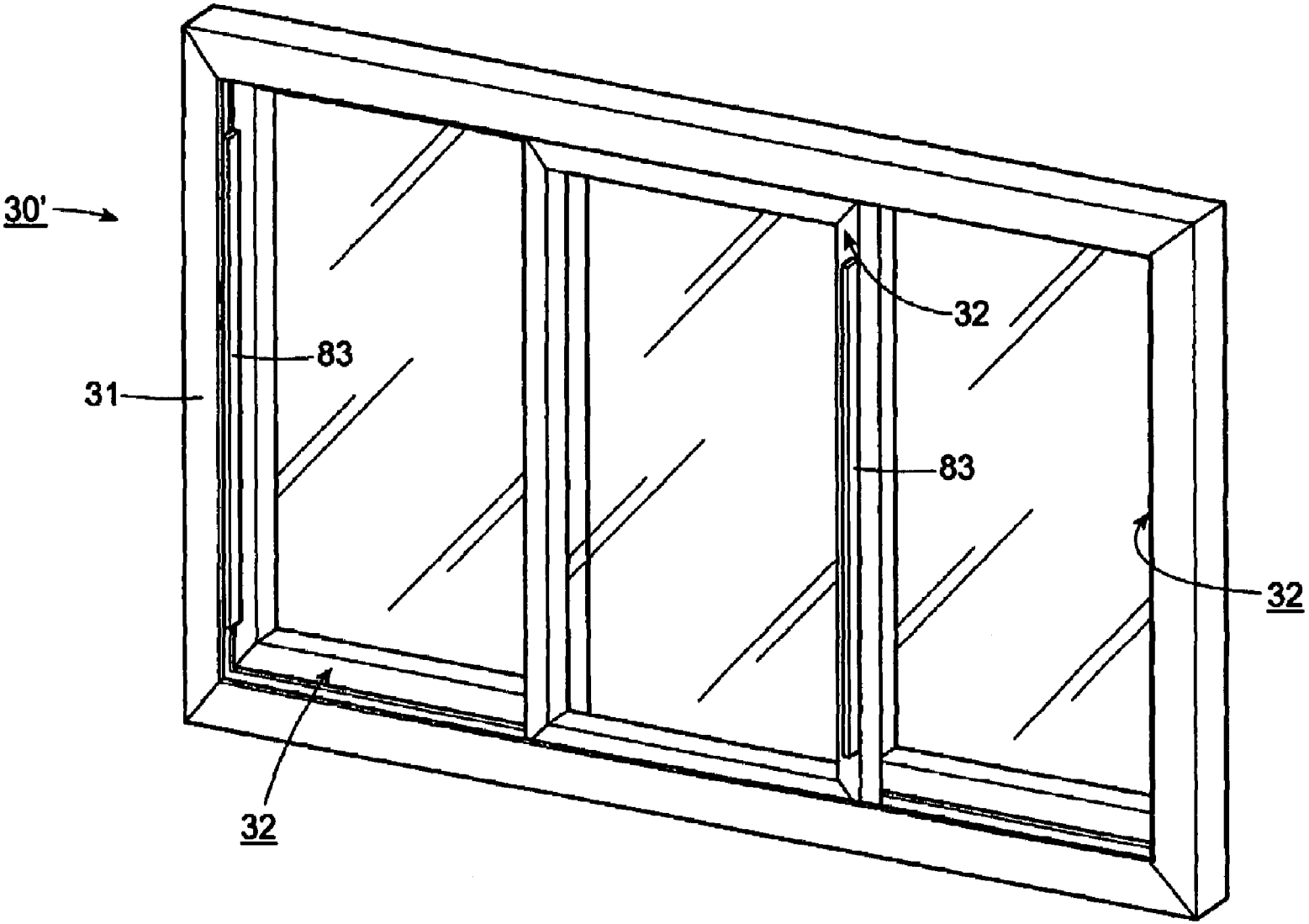
Figure 23:
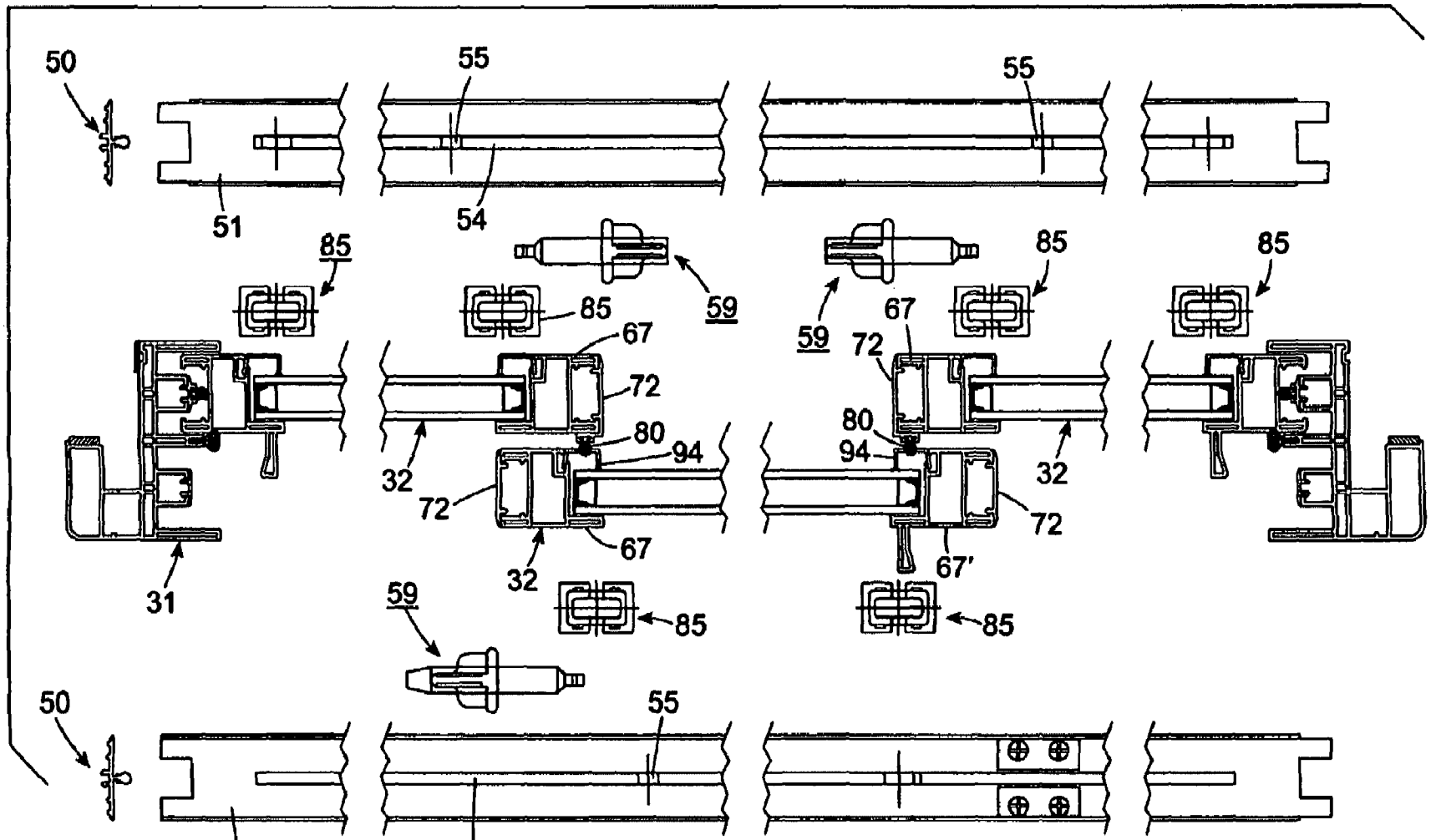

FIG. 17, FIG. 18, and FIG. 19 illustrate views of a wheel housing assembly for mounting in the bottom of the sash in accordance with the invention;

FIG. 20 illustrates a part cross-sectional view of a sash button mounted in a sash in accordance with the invention;

FIG. 21 illustrates a cross-sectional view of a glazing bead for holding a glass unit in the sash;

FIG. 22 illustrates a view of a three-door embodiment in accordance with the invention; and FIG. 23 schematically illustrates an exploded view of the three-door embodiment of FIG. 22.

Figure 1:
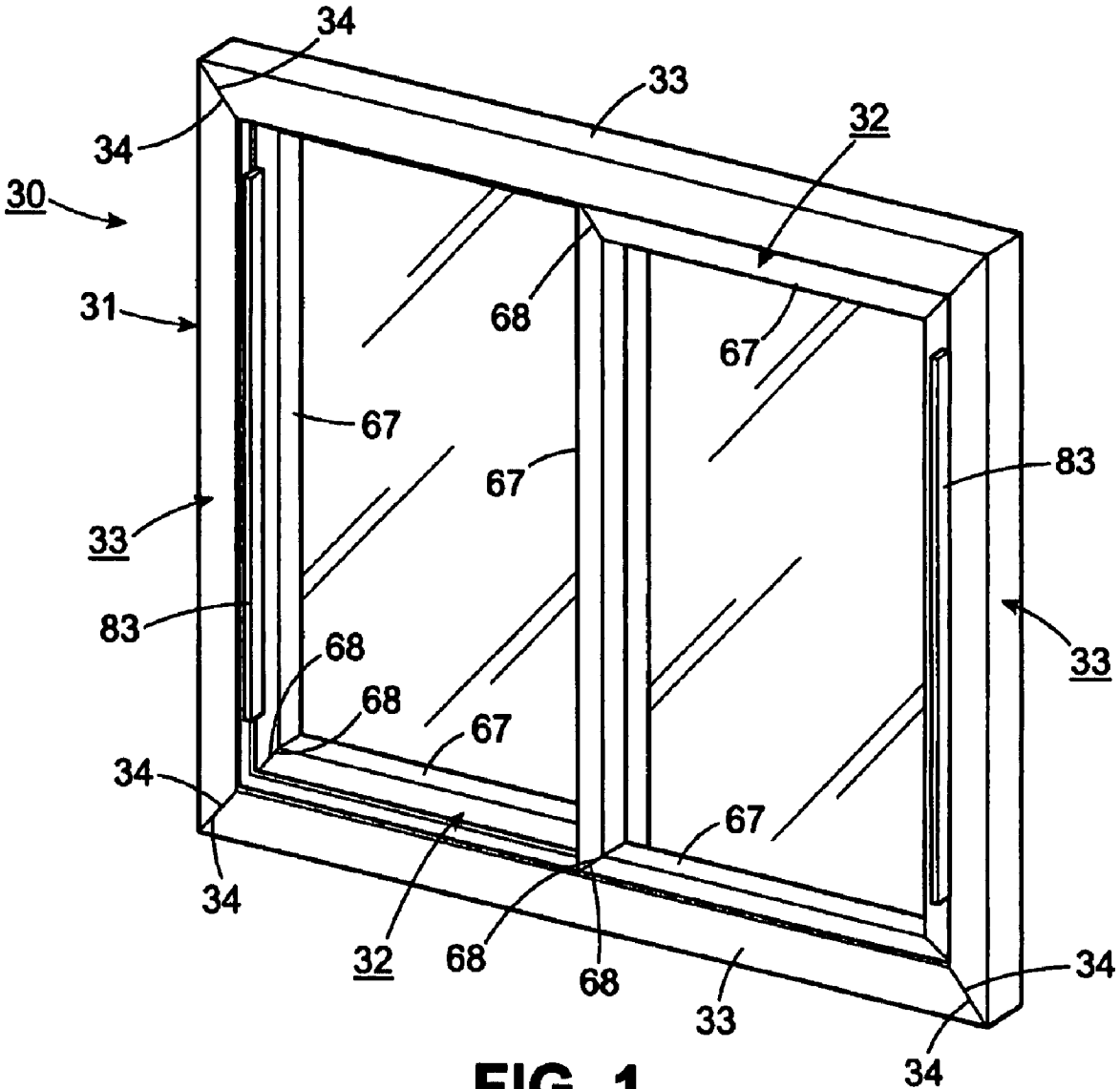
FIG. 1 illustrates a front view of a two-door sliding glass door assembly constructed in accordance with the invention.

Referring to FIG. 1, the sliding door assembly 30 is particularly constructed for use with insulated glass units but also may be made with monolithic glass or non-glass units or panels, based on OEM or end-user performance or aesthetic requirements.

The sliding glass door assembly 30 is comprised of a frame 31 and a pair of doors or sashes 32 that are slidably disposed in the frame 31 to move laterally between a closed position and an open position relative to the frame 31.

As illustrated, the frame 31 is of rectangular shape and is constructed to fit onto or within a refrigeration cabinet or refrigerated space or unit (not shown). The frame 31 is made of four plastic extrusion profiles 33 that are integrally secured together, as by thermal welding, to define a rectangular opening with each profile 33 having a mitered end 34 integrally secured to the mitered end 34 of an adjacent profile 33. In this respect, the four frame profiles 33 are formed from a single extrusion that is cut to length, mitered at each end and separated into four profiles. The resulting four profiles are then thermally welded together to form a strong joint and frame.

Figure 4:
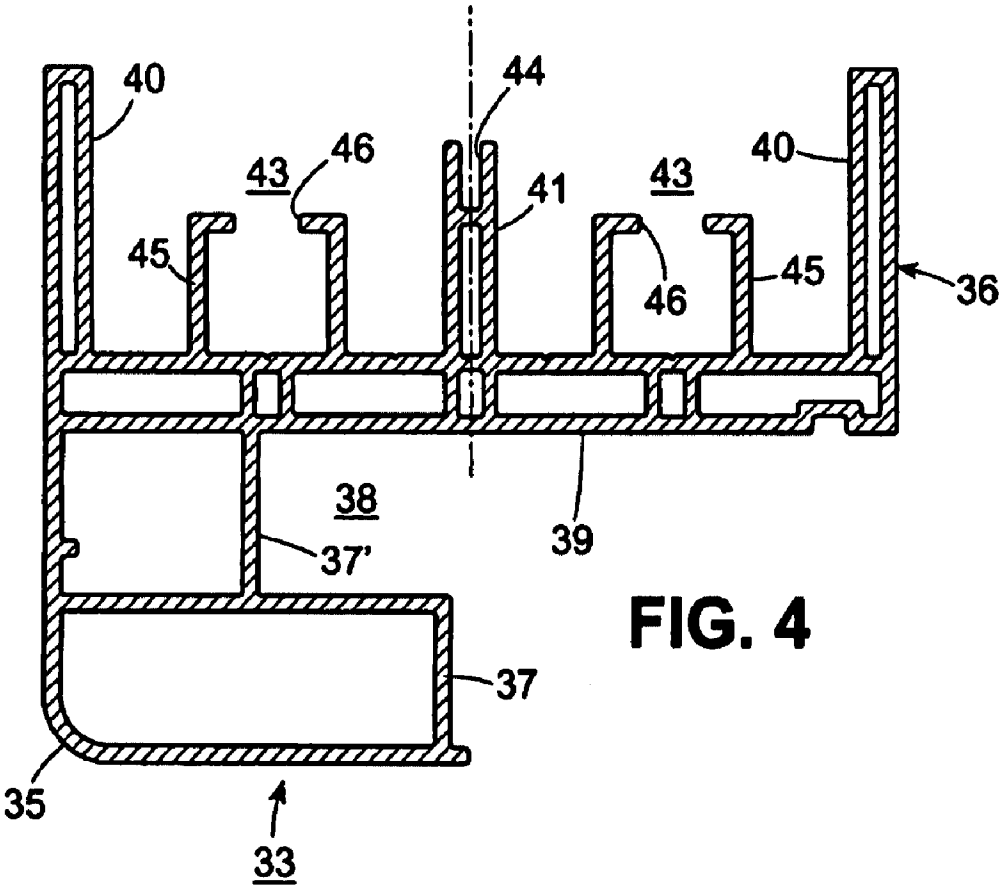
FIG. 4 illustrates a cross-sectional view of a frame extrusion profile in accordance with the invention.

Referring to FIG. 4, each frame profile 33 has the same cross-section formed of the rounded peripheral section 35 and a main section 36.

The peripheral section 35 is formed of two hollow portions 37,37' that define an L-shape for fitting against a cabinet (not shown). Where necessary, a metal stiffener (not shown) may be inserted into a gap 38 formed between the two portions 37,37'. For example, a standard steel or aluminum stiffener for strengthening the frame extrusion should a customer's cabinet not provide sufficient strength for the system in its base design. This provides the "option" of being able to stiffen the system as needed, as opposed to having to build in stiffening for every component shipped.

The main section 36 has a rectangular hollow body 39 from which a pair of hollow end walls 40 project to define a C-shape and a hollow intermediate wall 41 of shorter height disposed in parallel between the two end walls 40 to define a pair of longitudinal recesses or C-channels 43. In addition, the intermediate wall 41 has a longitudinal groove 44 in the upper end, as viewed.

In addition, an upstanding mounting channel 45 extends from the body 39 within each longitudinal recess or C-channel 43. As illustrated, each mounting channel 45 is of box-like cross-section with a pair of upstanding walls in each channel 43 and an elongated slot 46 at the upper end, as viewed.

Figure 2:
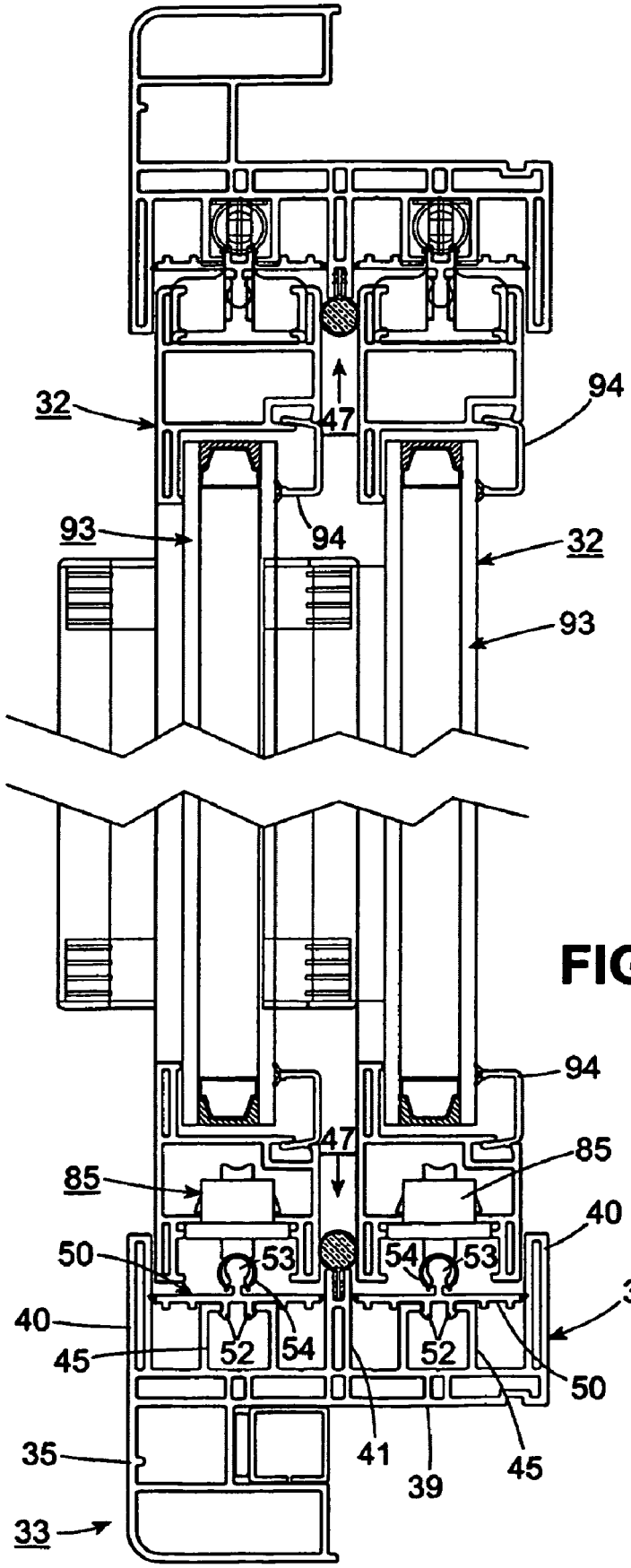
FIG. 2 illustrates a cross-sectional side view of the assembly of FIG. 1.
Figure 3:
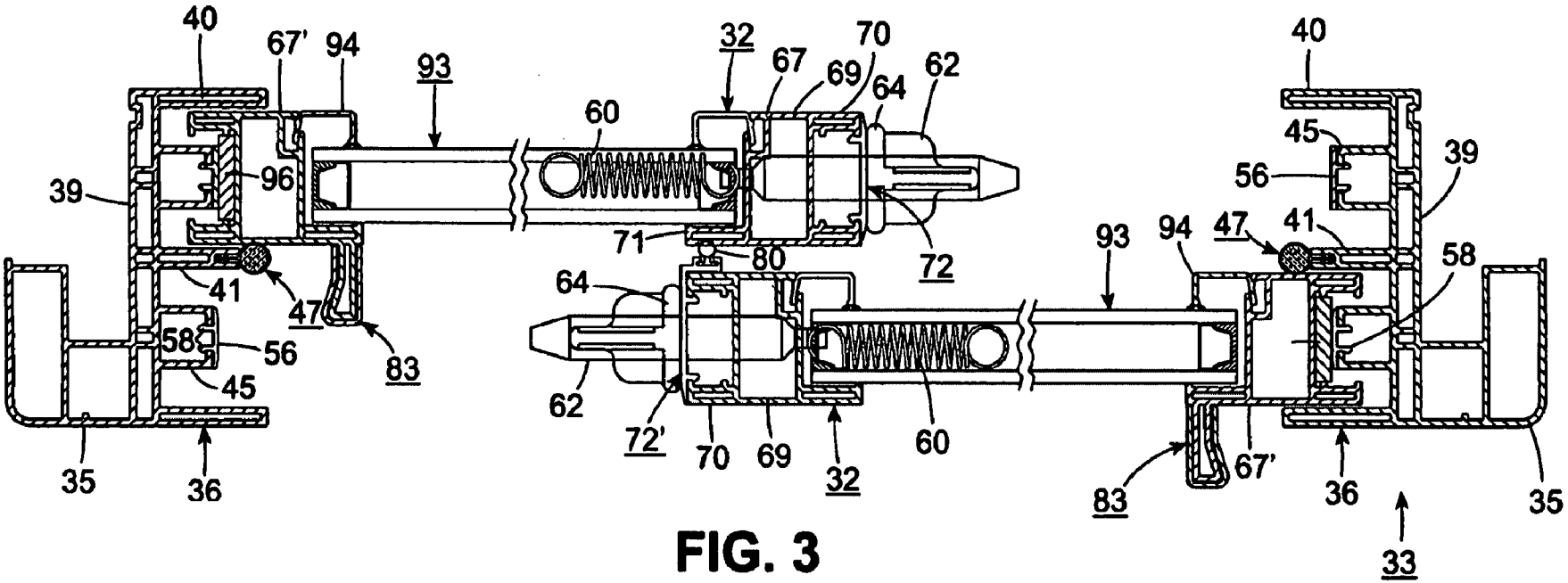
FIG. 3 illustrates a cross-sectional top view of the assembly of FIG. 1.
Figure 5:
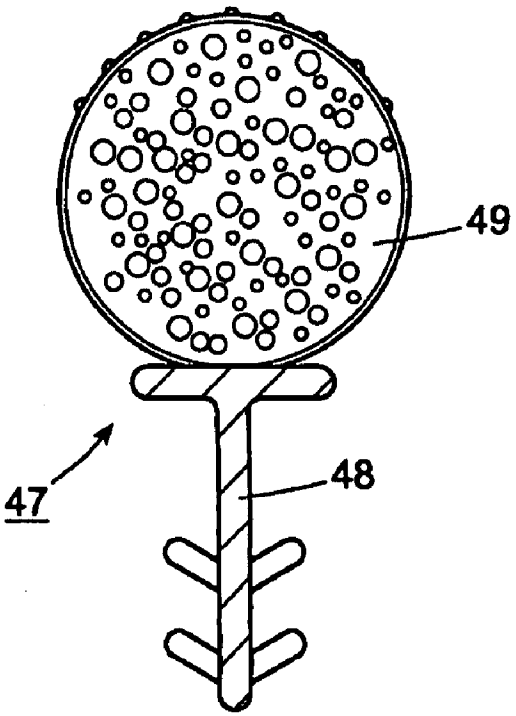
FIG. 5 illustrates a cross-sectional view of the snap-in gasket mounted in the intermediate wall of a frame profile in accordance with the invention.

Referring to FIGS. 2 and 3, a kerf bulb seal 47 is disposed on the intermediate wall 41 of each frame profile 33, for example in the groove 44 shown in FIG. 5, for sealingly engaging with a side of each of the sashes 32.

As illustrated in FIG. 5, each bulb seal 47 has a narrow dual-durometer plastic barb 48 that is co-extruded with a foam-filled gasket 49 so that the barb 48 can be readily and easily inserted into the groove 44 in the intermediate wall 41 of each frame profile 33. The shaping of the barb 48 is such that the seal will not easily pull out of the groove 44 in the intermediate wall 41 during normal use, yet can be removed for replacement at a later date should the need arise.

As illustrated, the foam filled gasket 49 is of circular cross-section and of a diameter so that when mounted in place is sufficient to sealingly contact the side of a sash 32 in the frame 31 and to fit within a gap between two overlapping sashes 32. Of note, three gaskets of different diameters are used that are very similar to that shown in FIG. 5. An oval gasket is used at the top of the frame and round ones are used on the sides and bottom of the frame, and also between the doors.

When the sashes 32 are in the closed position as illustrated in FIG. 1, the four bulb seals 47 that are mounted in the frame 31 contact three sides of each sash 32 in sealed relation.

Referring to FIG. 2, a pair of plastic sill track extrusions 50 are snap fitted into the mounting channels 45 of the lowermost horizontally disposed frame profile 33, i.e. the sill of the frame, for receiving the sashes 32 thereon.

Figure 6:
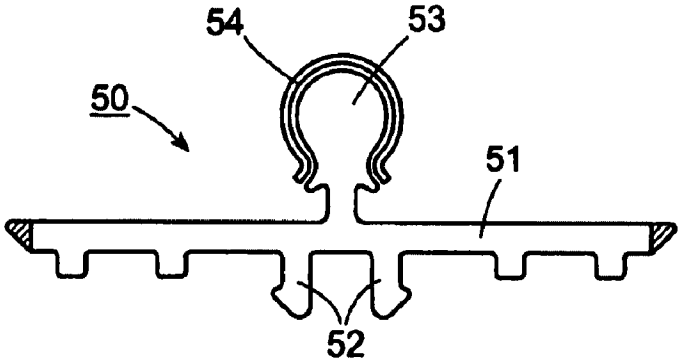
FIG. 6 illustrates a cross-sectional view of a roller or sill track extrusion in accordance with the invention.
Figure 7:
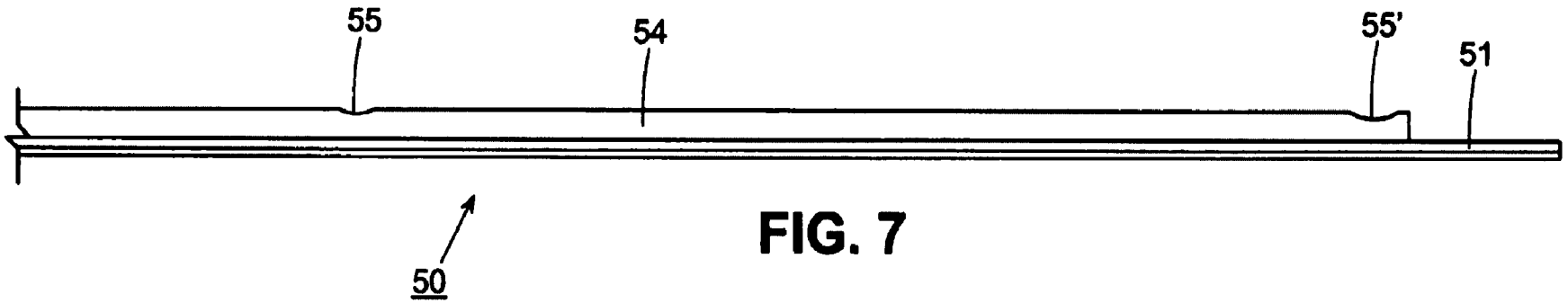
FIG. 7 illustrates a side view of the track cover in accordance with the invention.

Referring to FIGS. 6 and 7, each plastic track extrusion 50 has a main body 51 that is provided with a pair of resilient depending tangs 52 that allow for the extrusion 50 to be snap-fitted through the slot 46 of a mounting channel 45 of the frame profile (see FIG. 4). The remainder of the body 50 extends between the end walls 40 of the frame profile 33 in sealed relation to provide a smooth flat appearance.

In addition, each extrusion 50 has an upstanding rail 53 that extends mid-way along the extrusion 50. As indicated in FIG. 7, the forward and rear ends of the rail 53 are shortened during fabrication to facilitate the assembly of all of the snap-in components of the frame 31 and to address NSF cleaning requirements in the event of spills, so as to reduce bacteria growth by promoting ease of cleaning.

Also, each extrusion 50 is provided with bifurcated ends to fit around the mounting channel 45 in an adjacent vertical frame profile 33. Alternatively, the sill tracks may be butt-cut and the C-channels on the vertical jambs of the frame may be notched where they meet the sill of the frame to simplify installing the sill tracks and to clean up the silicone sealing of the sill tracks into the frame.

Referring to FIGS. 6 and 7, a stainless steel cover 54 is mounted over the rail 53 of each track extrusion 50 for wear purposes and to promote smooth operation of the doors.

As shown in FIG. 7, each cover 54 is provided with a "hold open" notch 55 for purposes of holding a sash 32 in an open position as explained below. A similar "hold close" notch 55' may also be provided in the cover 54 near the right-hand end of the rail, as viewed, to hold a sash 32 in the closed position.

Figure 8:
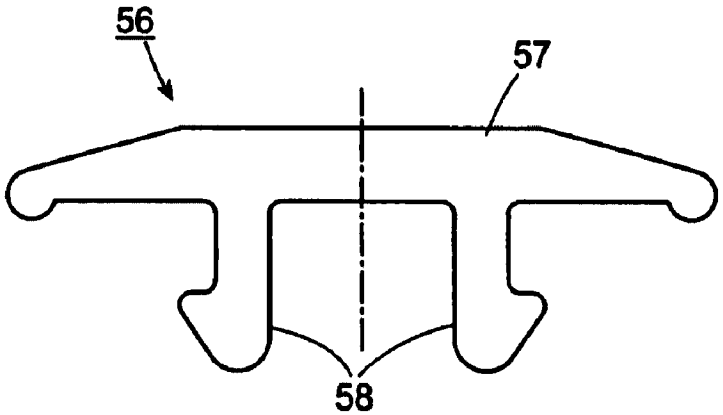
FIG. 8 illustrates a cross-sectional view of the frame channel plain cover in accordance with the invention.

Referring to FIG. 3, each mounting channel 45 on a vertical frame profile is provided with a cover 56 to present a flat aesthetic appearance. As illustrated in FIG. 8, each channel cover 56 is formed of an extrusion having a body 57 from which a pair of tangs 58 depend for snap fitting into the slot 46 defined by the mounting channel 45 of the frame profile 33. The body 57 of the channel cover 56 is of a width substantially equal to the width of the mounting channel 45.

In an alternative embodiment, not shown, the channel cover 56 may be provided with an upstanding slot or groove on an opposite side from the tangs 58 in order to receive an elongated T-slot bulb seal. In this embodiment, the bulb seal would include a T-shaped plastic base that slides within the slot of the channel cover and a foam-filled gasket of circular cross-section on the outside of the cover 56 that serves as a cushion against which a sash 32 may impact when moved into the closed position and as a redundant weather-seal to aid in insulation as needed.

Referring to FIG. 2, a pair of spring return assemblies 59 are mounted on the uppermost horizontally disposed frame profile 33 for biasing the two sashes 32 from their open positions to their closed positions. As illustrated, each spring return assembly 59 includes an elongated coil spring 60 and a slider 61. The spring 60 is mounted within a mounting channel 45 of the horizontal frame profile 33 with one end anchored as by a screw (not shown) to the frame profile 33 while the opposite end of the spring 60 is secured to the slider 61.

Figure 9:
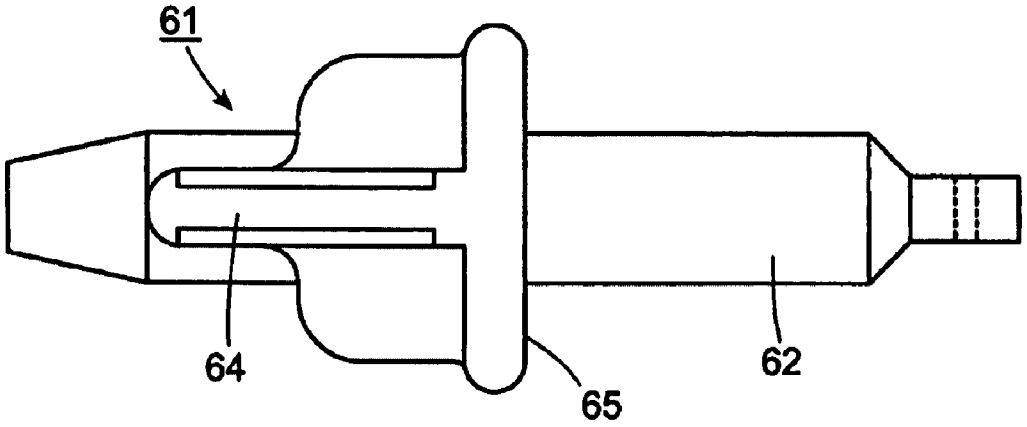
FIG. 9 illustrates a bottom view of the molded plastic self-closing device of the spring return assembly.
Figure 10:
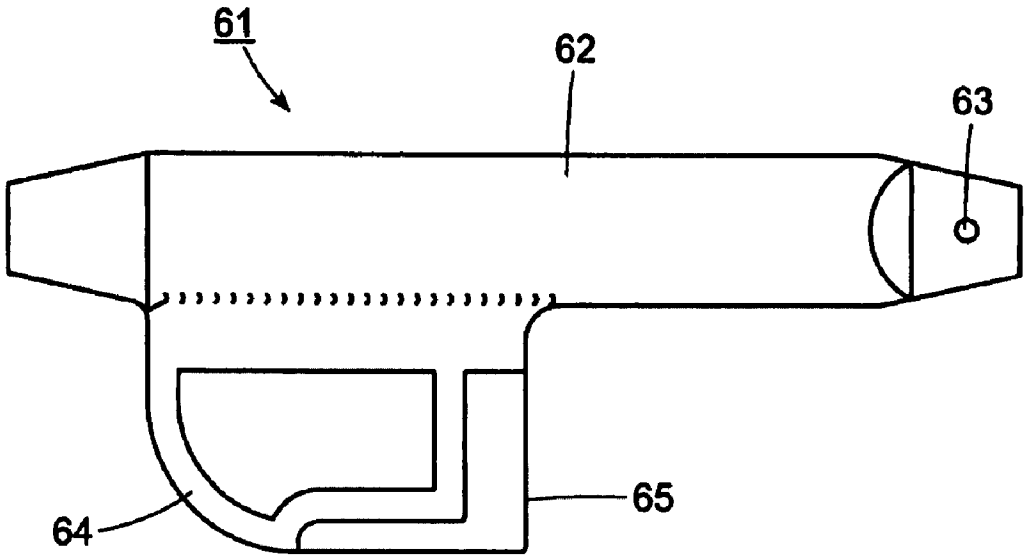
FIG. 10 illustrates a side view of the molded plastic self-closing device of the spring return assembly.

Referring to FIGS. 9 and 10, the molded plastic self-closing device (slider) 61 is formed with a main body 62 that is positioned in the mounting channel 45 and that has an opening 63 at a forward end to receive the coil spring 60 (not shown) for sliding within the channel 45. In addition, the slider 61 has a narrow depending stem 64 that projects downwardly through the slot 46 of the mounting channel 45 and a widened face 65 on the forward end of the stem 64 to abut against a sash 32.

The spring return assembly 59 is mounted in the horizontal frame profile 33 in a manner so that when a sash 32 is moved from the closed position, as shown in FIG. 3, to an open position, the spring 60 is elongated and placed under tension in order to bias the slider 61 and thus the sash 32 toward the closed position.

Figure 11:
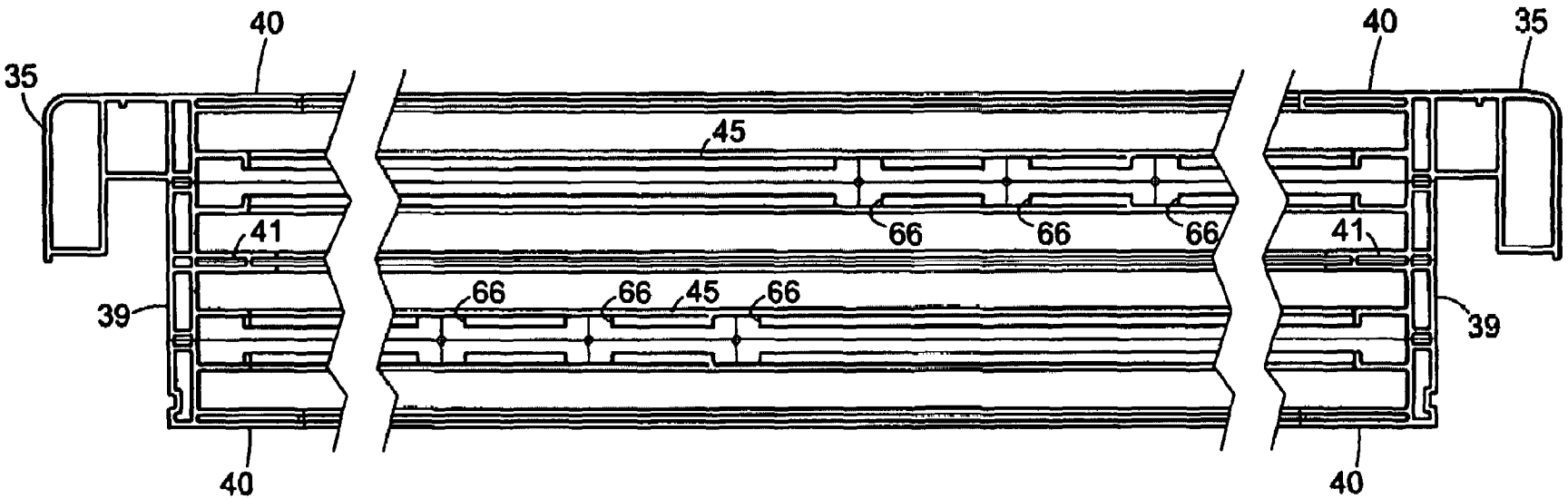
FIG. 11 illustrates a cross-sectional view of a plurality of access openings for inserting, attaching and modifying the tension in the spring return assembly.

Referring to FIG. 11, the mounting channels 45 in which the springs 60 are mounted are each provided with a plurality of access openings 66, (for example three) so as to permit access to the installation screws (not shown) that anchor the springs 60 in place so that adjustments may be made in the tension of the springs 60.

Referring to FIG. 1, each sash 32 is comprised of a plurality of plastic extrusion profiles 67, for example four, that are integrally secured together, as by thermal welding to define a rectangular opening. In addition, each sash profile 67 has mitered ends 68 that are integrally secured to a similar mitered end 68 of an adjacent sash profile 67.

Figure 12:
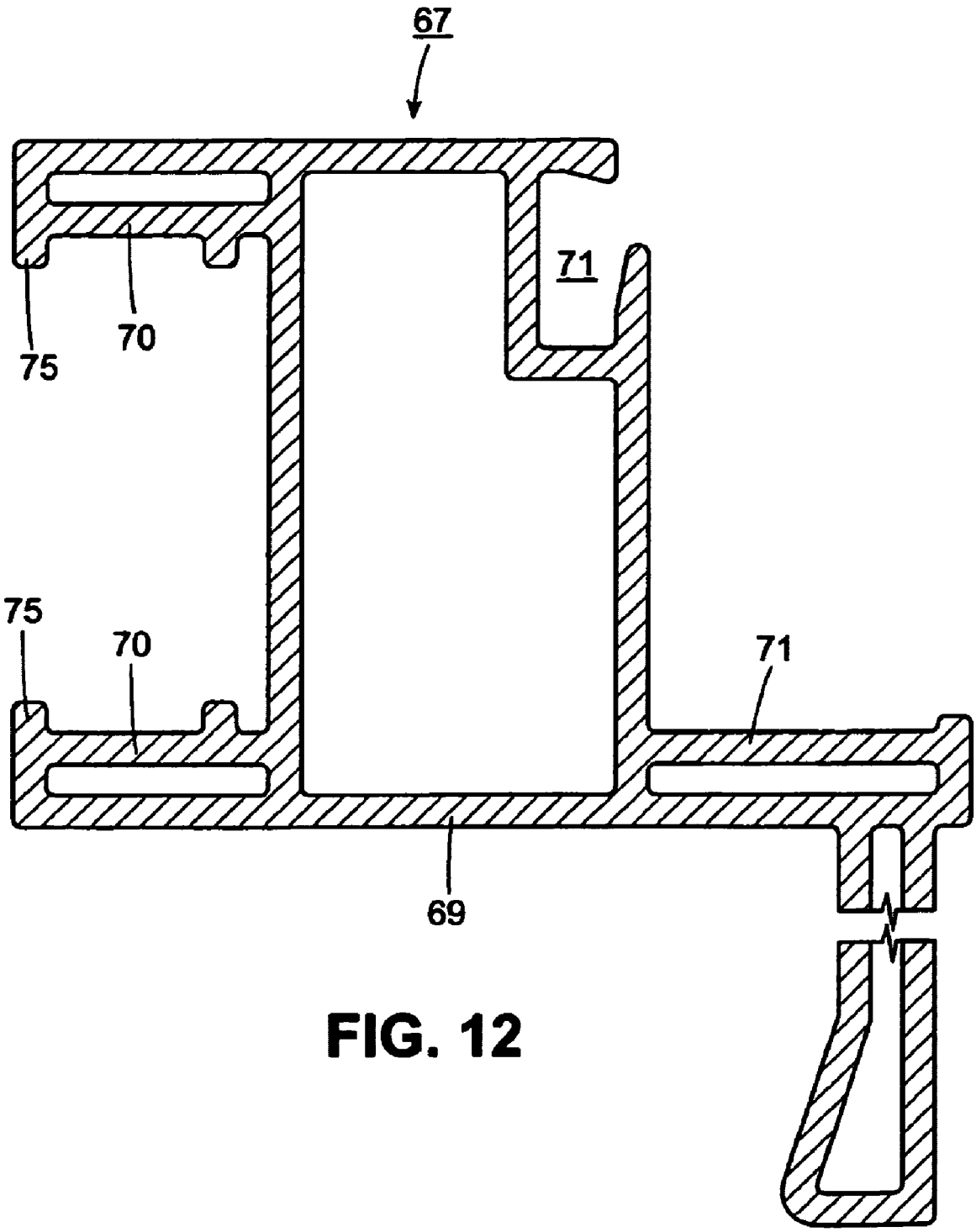
FIG. 12 illustrates a cross-sectional view of the common sash extrusion profile in accordance with the invention.

Referring to FIG. 12, each sash profile 67 is extruded with a hollow main body 69 of rectangular or box-shaped cross-section, a pair of hollow parallel flanges 70 that extend outwardly of the body 69 to define an outwardly directed channel to one side of the body 69 and a single hollow flange 71 that extends from the main body 69 to define an inwardly directed ledge on an opposite side of the body 69. In addition, a recess 71' is formed in the main body 69 on the side of the single flange 71 for receiving a glazing bead (not shown).

Figure 14:
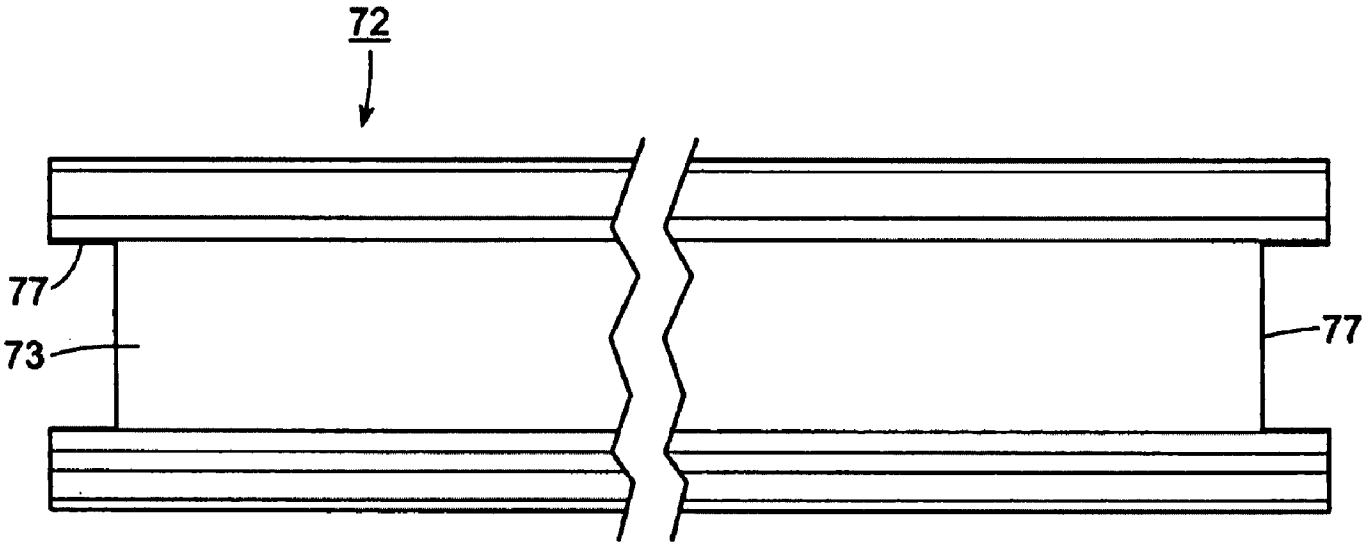
FIG. 13 and FIG. 14 illustrate views of a plain sash cover for mounting on a vertical profile of the sash.
Figure 13:
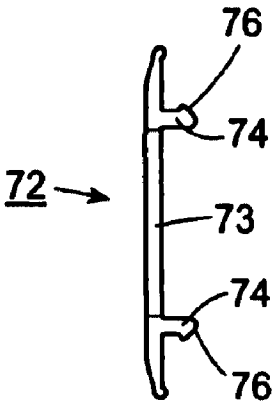

Referring to FIG. 3, each sash 32 is provided with a plain cover 72 to cover over the flanges 70 on the exposed vertical side of the sash 32. As illustrated in FIGS. 13 and 14, the sash cover 72 has a main body 73 from which a pair of tangs 74 project. The cover 72 is constructed to be slidably mounted in the side of the sash 32. In this respect, the flanges 70 that define the channel in the sash profiles 67 are each provided with an inwardly directed lip 75 (see FIG. 12) while the tangs 74 of the cover 72 are each provided with a small foot 76 (see FIG. 13) so that the tangs 74 can be slid between or snapped onto the lips 75 with the feet 76 of the tangs 74 engaging under the lips 75. In this way, the cover 72 cannot be pulled away from the side of the sash 32 but may be readily removed from one end of the sash 32 for replacement purposes.

As indicated in FIG. 13, the cover 72 is provided with a notch 77 at opposite ends to conform to the channel defined by the flanges 70 of the sash profiles 67 and not interfere with the movement of the sash 32 in the frame 31.

Figure 15:
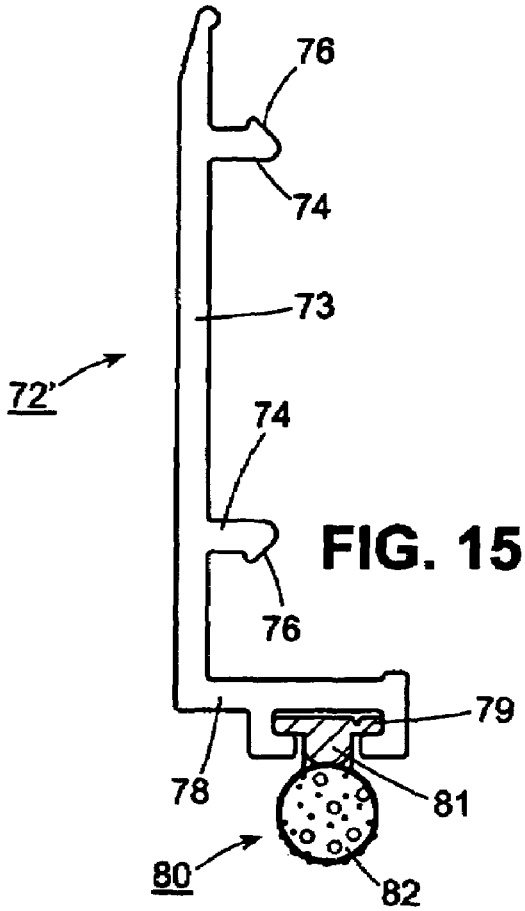
FIG. 15 illustrates a cross-sectional view of a sash cover with a bulb seal mounted therein.

Referring to FIGS. 3 and 15, the sash cover 72' on one of the sashes 32 is also provided with an extension 78 that carries a longitudinal T-shaped groove or slot 79 that receives a T-slot bulb seal 80. As indicated in FIG. 15, the seal 80 includes a T-shaped plastic body 81 that is slidably mounted in the groove 79 of the extension 78 and a foam-filled gasket 82 of circular cross-section carried by the plastic body 81.

As shown in FIG. 3, the bulb seal 80 sealingly engages against the flange 71 forming the ledge on the vertical sash profile 67 of the adjacent sash 32.

Figure 16:
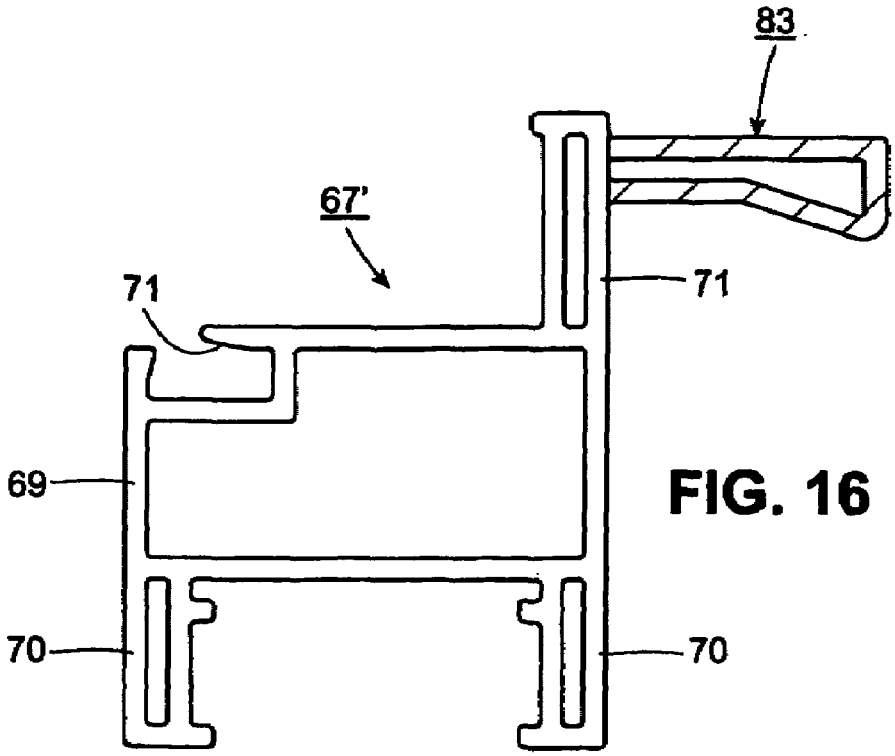
FIG. 16 illustrates a cross-sectional view of a sash profile with an integral handle.

Referring to FIGS. 2 and 3, each sash 32 is provided with a handle 83 for opening and closing of a sash 32. Whereas three of the sash profiles 67 are formed from the same extrusion, the sash profile 67' carrying the handle 83 is separately extruded from a different extrusion. As illustrated in FIG. 16, the handle 83 is integrally extruded with the sash profile 67' and is in the form of a projecting double walled hollow handle. If desired, plastic end caps 84 (see FIG. 2) may be fitted into the hollow ends of the handle 83. Each handle 83 extends over a substantial height of the vertical sash profile 67.

Referring to FIG. 2, each sash 32 carries a pair of roller assemblies 85, each of which is removably mounted in the lowermost one of the horizontally disposed sash profiles 67 for rolling on the stainless steel cover 54 on a track extrusion 50.

Referring to FIGS. 17, 18 and 19, each roller assembly 85 includes a plastic housing 86 that can be snap fitted into a recess (not shown) formed in the bottom of the horizontal sash profile 67. For example, the housing 86 has a skeletal box-like section 87 that projects through the recess (not shown) into the sash profile 67 and a peripheral flange 88 that seats against the outside of the sash profile 67. Both the box-like section 87 and the flange 88 are cut out to receive the ends of an axle 89 in snap fit relation upon which a ball bearing roller 90 is mounted for rotation.

Two of the opposite side walls of the box-like section 87 are provided with outwardly directed projections 91 that snap fit into the recess provided in the sash profile 67 to releasably hold the roller assembly 85 in place.

The mounting of each roller assembly 85 is such that the ball bearing roller 90 and axle 89 may be readily removed without removing the plastic housing 86 should the roller 90 need replacing.

The roller assemblies 85 provide for smooth rolling and low resistance and allow for installation without mechanical fasteners and allow for the wheel housings 86 to be field-replaceable without special hardware in the event of wear or damage. Likewise, the open wheel housing 86 allows the ball bearing roller 90 to be replaced without having to remove the entire housing 86 in the event of roller damage.

Referring to FIG. 20, the uppermost horizontal sash profile 67 may be provided with a glide button 92 at each end for guiding the sash 32 within the frame 31 and to assist in aligning the top of the sash 32 to ensure proper compression of the center bulb seal 47. As indicated, the glide button 92 is snap-fitted into one of the walls of a hollow flange 70 of the sash profile 67.

Referring to FIGS. 2 and 3, each sash 32 is provided with an insulating glass unit 93 that is dropped into place against the flange 71 forming the ledge of the sash 32 and is held in place by a glazing bead 94. As illustrated in FIG. 21, each glazing bead 94 has a channel-like cross-section with one leg 95 that fits into the recess 71' of the sash profile 67 and a second leg with a bifurcated end 95' that abuts the glass unit 93 in order to hold the glass unit 93 in place. As shown in FIG. 21, the leg 95 carries a shoulder. As shown in FIGS. 2 and 3, the leg 95 is snap-fit via the shoulder into the recess 71' to hold the glazing bead 94 in place The snap-in glazing bead construction combined with the drop-in construction of the insulated glass unit enables the insulating glass units to be field-replaceable if damaged, worn-out, or if end user simply desires to replace them for to improve performance, extend the life of the unit, update marketing presentation, and the like.

After each of the frame 31 and two sashes 32 have been fabricated, each sash 32 is fitted into the frame 31. In this respect, with the sash held at an angle, the flanges 70 at the top end of one sash 32 are fitted into the recesses defined to either side of the mounting channel 45 in the uppermost frame profile 33 between one of the end walls 40 and the intermediate wall 41 of the horizontal frame profile 33. During this time, the slider 61 of the adjacent spring biased assembly 59 is moved out of the way manually. The sash 32 is then lifted and rotated so that the bottom end of the sash 32 can be placed onto the sill track, that is between end wall 40 and intermediate wall 41 of the lowermost horizontal frame profile 33 to rest the roller assemblies 85 on the stainless steel sill track covers 54 of the sill track extrusions 50 therein. The slider 61 is then allowed to abut against the sash 32.

Thereafter, the second sash 32 is fitted into place in the frame 31 in the same manner.

Once the sashes 32 are in place, each sash 32 fits within the recesses provided by the frame profiles 33 so that the edges of the sashes 32 are hidden from view along three sides. As indicated in FIGS. 1 and 3, the exposed ends of the two sashes 32 are disposed in overlapping relation with the bulb seal 80 therebetween. As shown in FIG. 3, when each sash 32 is in a closed position, the flanges of the vertical sash profiles 67 fit between the end wall 40 and mounting channel 45 and between the channel 45 and the intermediate wall 41 of a vertical frame profile.

As shown in FIG. 3, the vertical sash profile 67 that faces the mounting channel 45 is provided with one or more bumpers 96 in the form of a neoprene stop that is glued on to the sash profile 67. This bumper 96 serves to cushion the impact of the sash 32 against the frame profile 33 when the sash 32 moves into a closed position.

In order to obtain access to a refrigerated cabinet upon which the door assembly is mounted, the user simply moves the handle 83 of a sash 32 from the closed position until the ball bearing roller 90 of the sash 32 nearest the handle 83 fits into the notch 55 in the stainless steel cover 54 (see FIG. 7). The notch 55 in the rail cover 54 is sufficient to hold the sash 32 against the biasing force of the return spring assembly 59. In order to close the sash 32, a slight force is imposed on the handle 83 to release the bearing roller 90 from the notch 55 in the rail cover 54. The tension in the spring 60 of the return spring assembly 59 then causes the sash 32 to move into the closed position within the contours of the vertical frame profile 33.

The sash 32 closing operates smoothly by balancing the closing forces of the linear tension spring 60 against the friction generated by the gasketing system 47, 80 to ensure minimal air infiltration while enabling smooth overall sash (door) operation.

As indicated in FIGS. 2 and 3, the two sashes 32 are sealed relative to the frame 31 and relative to each other by the respective seals 47, 80 to provide an efficient air-tight sealing system. The performance of the seals 47, 80 is sufficient to pass current industry standard thermal performance specifications for condensation prevention combined with required refrigeration requirements for cooling and achieving and maintaining desired product temperature.

Referring to FIGS. 22 and 23, wherein like reference characters indicate like parts as above, the door assembly 30' may be constructed with a frame 31 to accommodate a trio of moveable sashes 32 or as high as five or more doors based on opening size and equipment limitations.

As schematically illustrated in FIG. 23, each sash 32 is provided with a pair of roller assemblies 85 and cooperates with a spring return assembly 59 in the uppermost horizontal frame sash 33. In this respect, the middle sash 32 cooperates with a spring return assembly 59 that moves the sash 32 from a closed position, as shown, to an open position to the left, as viewed. In this respect, the middle sash 32 is provided with a handle 83 on the right-hand side.

In addition, the middle sash 32 is provided with covers 72 on both vertical sash profiles 67. Also, the covers 72 on the vertical sash profiles 67 of the left hand and right hand sashes 32 are provided with a seal 80 to seal against the glazing beads 94 on the middle sash 32. In this respect, should the left hand or right hand sash be open, only one of the seals 80 is moved relative to the middle sash 32.

The invention thus provides a fully assembled sliding door assembly that can be readily installed by an end user, for example, on a refrigerated cabinet or storage unit that utilizes components that can be readily replaced in the field should the components become damaged or worn.

The invention further provides a door assembly employing a frame and a sash made substantially completely of plastic, that does not require supplemental insulation against heat transfer between the sash and frame, and that does not require electrical insulation against electrical shock in the frame.

The invention provides a frame extrusion that utilizes an opposing open-leg or C-channel construction that creates an interior "accessory slot" that is utilized throughout the overall construction to create a "carrier" that can accept a wide variety of snap-in accessory extrusions or components. This feature allows the structural frame extrusion to be "customized" for many different sliding glass refrigerator door requirements by simply changing accessory extrusions that easily "snap-in" to the frame C-channel. This feature also allows for the rapid re-tooling or replacement of most of the key wear components in the overall door assembly without the need for any tools or complicated fabrication. This feature also provides a "platform" to facilitate future design improvements, enhancements, and the like, without the need for re-tooling the expensive structural extrusion components (i.e., frame, common sash and handle sash extrusions.)

What is claimed is:

1. A sliding door assembly comprising a frame including a plurality of plastic extrusion profiles including a pair of vertically disposed profiles and a pair of horizontally disposed profiles, each said profile having an end integrally secured to a respective end of an adjacent one of said profiles and each said profile including a pair of parallel end walls, a parallel intermediate wall defining a pair of longitudinal recesses between said end walls and a pair of parallel channels, each said channel being disposed in a respective one of said pair of recesses and having a pair of upstanding walls therein; and at least one sash slidably disposed in said frame for moving within a respective one of said pair of recesses of said pair of horizontally disposed profiles later ally between a closed position and an open position relative to said frame; said sash including a plurality of plastic extrusion profiles integrally secured together to define a opening, each said profile of said sash having an end integrally secured to a respective end of an adjacent one of said profiles of said sash.

2. A sliding door assembly as set forth in claim 1 further comprising at least a pair of said sashes disposed in said frame in a parallel manner.

3. A sliding door assembly as set forth in claim 2 further comprising an elongated seal mounted on said intermediate wall for sealingly engaging with a respective profile of a respective one of said sashes in said closed position of said one sash.

4. A sliding door assembly as set forth in claim 2 further comprising a pair of track extrusions, each said track extrusion being snap-fitted in a respective one of said channels of a lowermost one of said horizontally disposed profiles and a pair of rollers on each respective sash rollably mounted on a respective one of said pair of track extrusions.

5. A sliding door assembly as set forth in claim 4 further comprising a stainless steel cover on each track extrusion having a notch therein for receiving one of said pair of rollers in said open position of each respective sash.

6. A sliding door assembly as set forth in claim 2 further comprising a pair of spring biased assemblies, each said spring biased assembly being disposed in a respective one of said channels of an uppermost one of said horizontally disposed profiles of said frame for biasing a respective one of said sashes from said open position thereof to said closed position thereof.

7. A sliding door assembly as set forth in claim 6 wherein each said spring assembly includes a slider slidably mounted on a respective one of said channels for abutting a respective one of said sashes during movement of said one sash between said closed position and said open position thereof and an elongated coiled spring disposed in a respective one of said channels with one end secured in fixed relation therein and an opposite end secured to said slider for biasing said slider against said one of said sashes and for biasing said one of said sashes towards said closed position thereof.

8. A sliding door assembly as set forth in claim 6 further comprising an elongated seal mounted on said intermediate wall for sealingly engaging with a respective profile of a respective one of said sashes in said closed position of said one sash.

9. A sliding door assembly as set forth in claim 2 further comprising a pair of track extrusions, each said track extrusion being disposed on a respective one of said channels of a lowermost one of said horizontally disposed profiles; a pair of rollers on a respective one of said sashes rollably mounted on said track extrusion; and a pair of spring biased assemblies, each said spring biased assembly being disposed in a respective one of said channels of an uppermost one of said horizontally disposed profiles for biasing a respective one of said sashes from said open position hereof to said closed position thereof.

10. A sliding door assembly as set forth in claim 9 further comprising a stainless steel cover on each track extrusion having a notch therein for receiving and holding one of said pair of rollers in said open position of said one sash against the biasing force of said spring biased assembly.

11. A sliding door assembly as set forth in claim 2 wherein each said profile of each said sash has a pair of parallel flanges defining an outwardly directed channel and at least one glide button snap-fitted onto one of said flanges of an uppermost one of a horizontally disposed one of said profiles of said sash for guiding said sash within said frame.

12. A sliding door assembly as set forth in claim 11 further comprising an elongated cover extrusion mounted on said flanges of a vertically disposed profile of one of said sashes and an elongated seal mounted on said extrusion for sealing against a vertically disposed profile of the other of said sashes in said closed position of each said sash.

13. A sliding door assembly as set forth in claim 11 further comprising an integral hollow handle on a vertically disposed profile of each of said sashes.

14. A sliding door assembly as set forth in claim 1 further comprising an insulated glass unit disposed within said profiles of said sash.

15. A sash for a sliding glass door assembly comprising a plurality of plastic extrusion profiles integrally secured together to define an opening, each said profile having an end integrally secured to a respective end of an adjacent one of said profiles and having a cross-section defining a pair of parallel flanges defining an outwardly directed channel on one side, a single flange defining an inwardly directed ledge on an opposite side and a recess on said opposite side for receiving a glazing bead; and a pair of roller assemblies removably mounted in a lowermost one of a horizontally disposed one of said profiles and projecting therefrom and wherein each said roller assembly includes a plastic housing snap fitted into a bottom of said lowermost one of said horizontally disposed one of said profile.

16. A sash as set forth in claim 15 further comprising an elongated cover extrusion mounted on said flanges of a vertically disposed one of said profiles and having a longitudinal slot on a side of said one profile and an elongated seal slidably mounted in said slot of said extrusion.

17. A sash as set forth in claim 15 further comprising an integral double wall hollow handle on a vertically disposed one of said profiles.

18. A sash as set forth in claim 15 further comprising an insulated glass unit disposed within said rectangular opening of said profiles and against said ledge of each said profile, and an extruded glazing bead removably mounted in said recess of each respective one of said profiles to retain said insulated glass unit therein, each said glazing bead having a surface flush with a surface of said respective profile.

19. A sash as set forth in claim 15 wherein said profiles are made of polyvinylchloride.

20. A sash as set forth in claim 15 wherein each said roller assembly includes an axle disposed in snap fit relation in said housing and a roller mounted for rotation on said axle.

21. A frame for a sliding door assembly comprising a plurality of plastic extrusion profiles integrally secured together to define an opening;

each said profile having an end integrally secured to a respective end of an adjacent one of said profiles to define an opening; and each said profile having a cross-section defining a pair of parallel end walls, a parallel intermediate wall defining a pair of longitudinal recesses with said end walls, and a pair of parallel channels, each said channel being disposed in a respective one of said pair of recesses and having a pair of upstanding walls therein and wherein said frame further comprises an elongated cover snap-fitted into at least one of said channels of a vertically disposed one of said profiles.

22. A frame as set forth in claim 21 further comprising an elongated seal mounted on said intermediate wall of each of a pair of vertically disposed profiles and a pair of horizontally disposed profiles extending between said pair of vertically disposed profiles.

23. A frame as set forth in claim 21 further comprising a pair of spring biased assemblies, each said spring biased assembly having an elongated coil spring disposed in a respective one of said channels of an uppermost one of a horizontally disposed profile with one end secured in fixed relation therein and a slider secured to an opposite end of said spring and slidably mounted on said respective one of said channels for biasing a sash within said frame-towards a closed position therein.

24. A frame as set forth in claim 23 wherein each said channel has a plurality of longitudinally spaced enlarged openings to provide access to said one end of said spring fixed thereat.

25. A frame for a sliding door assembly comprising:

a plurality of plastic extrusion profiles integrally secured together to define an opening;

each said profile having an end integrally secured to a respective end of an adjacent one of said profiles to define an opening, and each said profile having a cross-section defining a pair of parallel end walls, a parallel intermediate wall defining a pair of longitudinal recesses with said end walls, and a pair of parallel channels, each said channel being disposed in a respective one of said pair of recesses hand having a pair of upstanding walls therein; and the frame further comprising a pair of track extrusions, each said track extrusion being snap-fitted in a respective one of said channels of a lowermost one of a horizontally disposed profile of said profiles for receiving a sash thereon.

26. A frame as set forth in claim 25 further comprising a stainless steel cover on each track extrusion for rollably receiving a roller thereon.

27. A sliding glass door assembly comprising a frame including a plurality of plastic extrusion profiles integrally secured together to define an opening, each said profile having an end integrally secured to a respective end of an adjacent one of said profiles and having a cross-section defining a pair of parallel end walls and a parallel intermediate wall;

at least a pair of sashes, at least one of said pair of sashes being disposed in said frame between a respective end wall and intermediate wall of at least two oppositely disposed profiles of said frame, at least one of said pair of sashes being movably disposed in said frame to move laterally between a closed position and an open position relative to said frame and in overlapping relation to the other of said pair of sashes; said one sash including a plurality of plastic extrusion profiles integrally secured together to define a rectangular opening, each said profile of said one sash having an end Integrally secured to a respective end of an adjacent one of said profiles of said one sash;

a pair of insulating glass units, each said insulating glass unit being disposed within said profiles of a respective one of said pair of sashes; and an elongated seal mounted on said intermediate wall of each said profile for sealing against a side of a respective sash of said pair of sashes.

28. A sliding glass door assembly as set forth in claim 27 further comprising an elongated seal slidably mounted on a vertically disposed profile of one of said sashes for sealing against a vertically disposed profile of the other of said sashes in said closed positions thereof.

* * * * *

UNITED STATES PATENT AND TRADEMARK OFFICE

CERTIFICATE OF CORRECTION

PATENT NO. : 8,176,680 B2
APPLICATION NO. : 11/544215
DATED : May 15, 2012
INVENTOR(S) : Richard A. Chubb et al.

It is certified that error appears in the above-identified patent and that said Letters Patent is hereby corrected as shown below:

Column 14
Line 54, change “hand” to -- and --

Signed and Sealed this
Nineteenth Day of June, 2012

David J. Kappos

David J. Kappos
*Director of the United States Patent and Trademark Office*